United States Patent [19]

Fukuyori

[11] Patent Number: 4,617,818

[45] Date of Patent: Oct. 21, 1986

[54] STRUCTURAL METAL SHEET AND METHOD FOR FORMING THE SAME

[75] Inventor: Kazusige Fukuyori, Kudamatsu, Japan

[73] Assignee: Hitachi, Ltd., Tokyo, Japan

[21] Appl. No.: 520,850

[22] Filed: Aug. 5, 1983

[30] Foreign Application Priority Data

Aug. 16, 1982 [JP] Japan ..... 57-141111

[51] Int. Cl.[4] ..... B21D 17/02

[52] U.S. Cl. ..... 72/379; 72/307; 72/350; 52/630

[58] Field of Search ..... 72/296, 297, 305, 350, 72/379, 351, 307, 179, 182, 176, 701, 177, 347, 348, 414, 415; 52/630

[56] References Cited

U.S. PATENT DOCUMENTS

| | | | |
|---|---|---|---|
| 2,313,111 | 3/1943 | Wilson | 72/365 |
| 2,330,572 | 9/1943 | Frey et al. | 72/414 |
| 2,831,521 | 4/1958 | Collins | 72/379 |
| 2,980,046 | 4/1961 | McGregor et al. | 72/414 |
| 3,073,021 | 1/1963 | Goodwill et al. | 72/366 |
| 4,211,102 | 7/1980 | Hurvitz | 72/351 |
| 4,400,965 | 8/1983 | Schey | 72/347 |

*Primary Examiner*—Lowell A. Larson

*Attorney, Agent, or Firm*—Antonelli, Terry & Wands

[57] ABSTRACT

A structural metal sheet employed as an outer sheet for a railway vehicle, for example, is generally pretensioned in order to prevent buckling. Hitherto, the pretensioning is effected by various methods after or during the assembly of a structure. According to the invention, the metal sheet itself is pretensioned by a plastic working for increasing the flexural rigidity thereof. Thus, there is no fear of buckling, and the workmanship is improved as compared with the prior art.

3 Claims, 10 Drawing Figures

STRUCTURAL METAL SHEET AND METHOD FOR FORMING THE SAME

BACKGROUND OF THE INVENTION

The present invention relates to a structural metal sheet and a method for forming the same, and more particularly, to a structural metal sheet suitable for use as an outer metal sheet of a monocoque construction (skin-stressed sheet-metal body construction) such as a railway vehicle body having an outer sheet pretensioned in order to increase the buckling strength thereof.

Referring to FIG. 1 showing prior art, a general railway vehicle structure 1 has members which are made thin in order to allow the vehicle to be more lightweight and are arranged to minimize the number of required members. Accordingly, a monocoque construction is adopted, in which the outer metal sheet serves as an important strengthened member. By the way, when a load is placed on the structure 1, a deflection h is produced, and a buckling $\delta$ arises in the outer metal sheet as shown in FIG. 1.

Therefore, the outer metal sheet is generally pretensioned so as to be prevented from buckling. A conventional pretensioning method is such that the outer metal sheet is subjected to spot-heating-and-quenching after the structure is assembled. Another conventional method is such that the outer metal sheet is pretensioned by pulling the same when it is attached to the frame or expanding the outer metal sheet by heating and securing the same to the frame. However, the spot-heating-and-quenching method is poor in finished appearance and unfavorably increases the number of working steps. On the other hand, the other method inconveniently requires a special-purpose equipment and also increases the number of working steps disadvantagously.

SUMMARY OF THE INVENTION

Accordingly, it is an object of the invention to provide a structural metal sheet which resists deformation and has an excellent appearance.

It is another object of the invention to facilitate the pretensioning of a structural metal sheet such as the above-mentioned outer metal sheet.

To these ends, according to one aspect of the invention, there is provided a structural metal sheet constituted by a metal sheet formed with beads by a plastic working thereby to pretension the metal sheet in a necessary degree before the same is secured to a frame.

Moreover, according to another aspect of the invention, there is provided a method for forming a structural metal sheet characterized in that a plastic working is carried out so that the structural metal sheet is provided with a bead portion while being pretensioned.

Above and other objects, features and advantages of the invention will become apparent from the following description taken in connection with the accompanying drawings.

DESCRIPTION OF THE PREFERRED EMBODIMENTS

Figure 1:
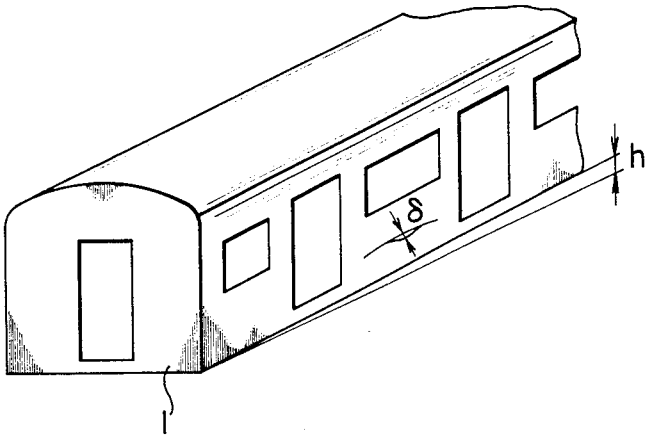
FIG. 1 shows the external appearance of a general railway vehicle structure.
Figure 2:
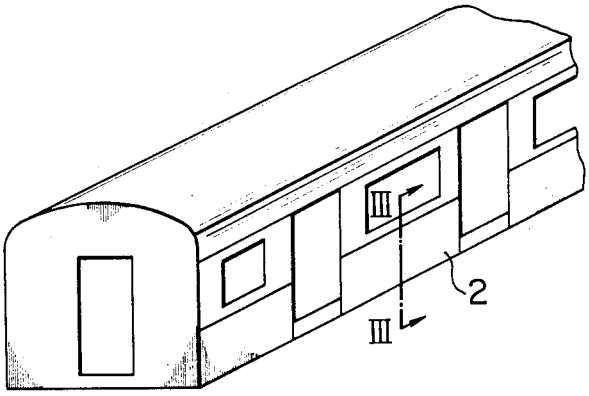
FIG. 2 shows the external appearance of a railway vehicle structure having panels of a structural metal sheet in accordance with the invention.

An embodiment of a structural metal sheet in accordance with the invention will be described hereinunder with reference to FIGS. 2 to 5. As shown in FIG. 2, an outer metal sheet 2 for a railway vehicle comprises a panel having a size smaller than that of the outer metal sheet 2 in taking into account the construction of the structure and the plastic working therefor, which panel has a length of 2000 to 6500 millimeters, a width of 600 to 1000 millimeters and a thickness of 1.2 to 1.5 millimeters and is made of a stainless steel of AISI 301.

Figure 3:
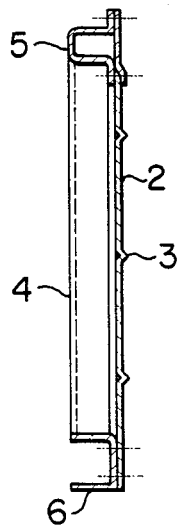
FIG. 3 is a sectional view taken along the line III—III of FIG. 2.
Figure 4A:
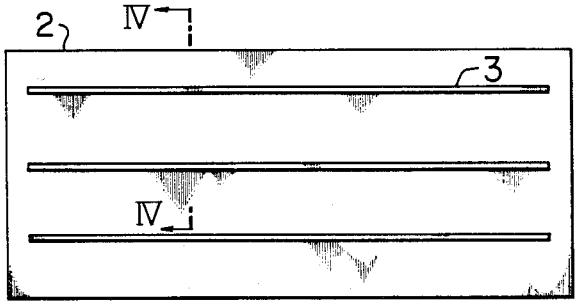
FIGS. 4A and 4B are a front elevational view of an outer metal sheet in accordance with the invention and a sectional view taken along the line IV—IV in FIG. 4A, respectively.
Figure 4B:
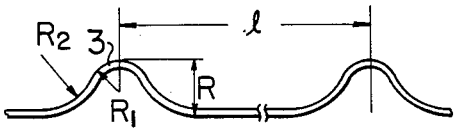
Figure 5:
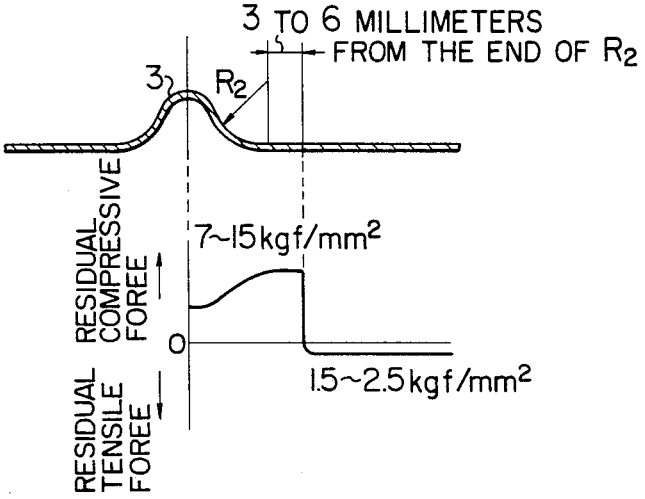
FIG. 5 is a chart showing the residual stress distribution in the outer metal sheet shown in FIG. 4B.

The following is the description of the outer metal sheet 2. The outer metal sheet 2 is secured to frame members 4, 5, 6 by means of spot welding as shown in FIG. 3. The outer metal sheet 2 is formed to have bead portions 3 each having a height (h) of 8 mm, a radius ($R_1$) of curvatuve of 5 mm at the top thereof and another radius ($R_2$) of curvature of 10 mm at the bottoms of the bead portion, as shown in FIGS. 4A, 4B, by subjecting a flat sheet to a plastic working, the adjacent two bead portions being spaced from each other by a distance (l) of 150–200 mm. The thus formed outer metal sheet 2 has an internal stress distribution as shown in FIG. 5: compressive stresses are produced in the bead portions 3 and the vicinities thereof, while tensile stresses are produced in the flat sheet portions. In other words, a portion of large flexural rigidity is subjected to a compressive force, while a portion of small flexural rigidity is subjected to a tensile force. Therefore, when the outer metal sheet 2 is spot-welded to the frame members 4, 5, 6 to form a structure, it is possible to prevent the occurrence of buckling of flat sheet portions which otherwise causes concave and convex portions.

That is, when compressing the panel having the beads from the ends of the panel, the beads can bear the stress, however, a flat portion thereof is easily apt to be buckled. To prevent the buckling from occurring in the flat portion, there are provided residual tensile stresses in the flat portion of the panel as shown in FIG. 5.

Each panel of the outer metal sheet 2 is manufactured by, for example, pressing a flat sheet to form beads thereon. In the formation, each bead portion 3 is strongly pressed to cause therein a compressive stress several times as large as the yield point or proof stress of the material therefor so that the residual stress after the formation becomes the compressive stress.

Figure 6:
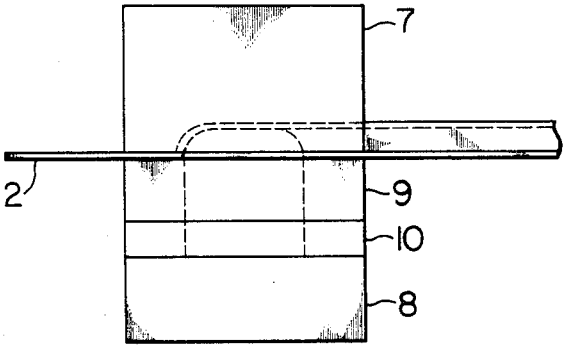
FIGS. 6 and 7 are a front elevational view and sectional side elevational view of a conventional nibbling die used ordinarily in forming a bead.
Figure 7:
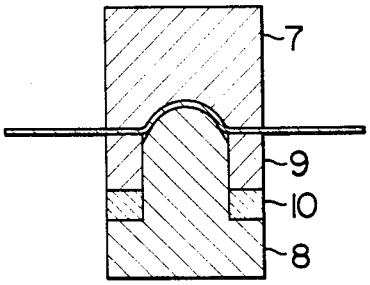

In the case of formation of the panel by means of a press, it is the most general method to employ a die having a size large enough to form the whole of a bead at one time. However, in the case where such a largesized press is not available or the tooling cost is desired to be saved for a small-scale production, such a method is available that a short forming die is employed, and a local forming is successively repeated until a bead of predetermined length is formed. In such a practical method, a conventional forming die as shown in FIGS. 6, 7 is employed. In the drawings, a reference numeral 7 denotes an upper die, and numerals 8, 9 and 10 designate a punch, lower die and spring, respectively. With such forming die, the outer metal sheet 2 is fed with a pitch not larger than several millimeters to successively repeat the press forming until a bead of predetermined length is formed. This conventional method has a drawback in that when a bead is formed the flat sheet portions on both sides of the bead are drawn to unfavorably cause distortion in the panel. To avoid this drawback according to the forming method of the present invention, a bead is formed while the panel is restrained from being drawn by means of the upper and lower dies.

Figure 8:
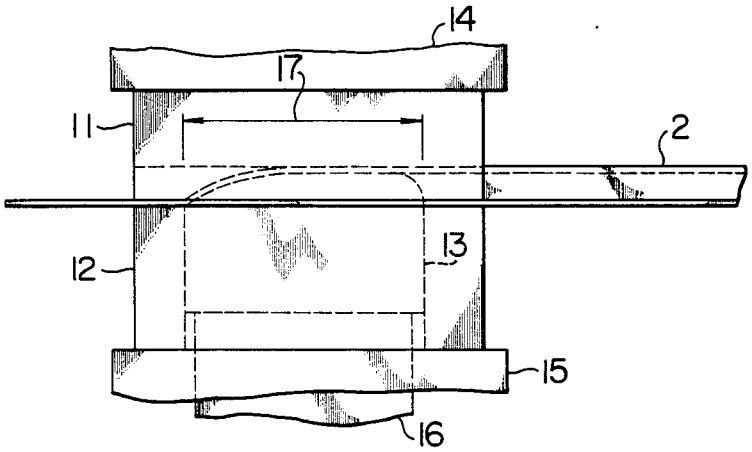
FIGS. 8 and 9 are a front elevational view and sectional side elevational view showing how a bead is formed by a bead forming method in accordance with the invention.
Figure 9:
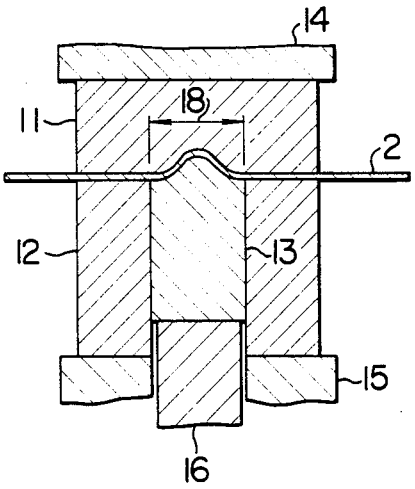

An embodiment of the forming method in accordance with the invention will be explained hereinunder with reference to FIGS. 8 and 9. An upper die 11 and a lower die 12 both made of an alloy of SKS 11 are attached to beds 14 and 15 of a press, respectively. The panel for the outer metal sheet 2 is clamped from the upper and lower sides by the upper and lower dies 11 and 12 which both have a length of 400 mm and a width of 280 mm. The sheet 2 is pressed for restraint by the beds 14 and 15 through these dies. The pressing force (P) in this case should be large enough for completely restraining the panel for the outer metal sheet 2 from being drawn during forming of the bead, by means of both the frictional force (f·p) between the upper die 11 and the upper surface of the panel and the frictional force (f·p) between the lower die 12 and the lower surface of the panel for the outer metal sheet 2 (wherein (f) is friction coefficient). In other words, the panel of the outer metal sheet 2 is pressed for restraint with a frictional force (2p·f) which is larger than the tensile strength ($\sigma_B$) thereof, that is, $P > \sigma_B/2f$. Next, a punch 13 is pushed up by means of a cylinder rod 16 as illustrated to form a bead having a width of about 47 mm as well as to press the bead portion so strongly that the residual stress after the formation will be a compressive stress. Upon completion of the formation of the bead, the cylinder rod 16 is lowered to withdraw the punch 13 having a length 17 of about 260 mm, and the pressing force on the upper die 11 is released to pull up the upper die 11. Thereafter, the outer metal sheet 2 is fed with a feed two to five times as large as a bead width 18 to repeat the bead forming process. Thus, the panel of the outer metal sheet 2 is worked so that a bead of predetermined length may be formed thereon.

It has been proved from the results of experiments that with the method of the invention it is possible to obtain a panel with an excellent appearance having little unevenness on the bead surface if a punch length 17 is not less than five times as large as the bead width 18 of about 47 mm. In addition, in view of the necessity for a press of large pressing force, it is practical to select the punch length 17 to be about 20 times as large as the bead width 18.

According to the invention, the structural metal sheet can be easily pretensioned in a necessary degree, so that there is no fear of buckling, and the finished surface of the metal sheet can be advantageously improved in appearance.

Although the invention has been described through specific terms, it is to be noted here that the described embodiments are not exclusive and various changes and modifications may be imparted thereto without departing from the scope of the invention which is limited solely by the appended claims.

What is claimed is:

1. A method for forming a structural metal sheet provided with both a bead portion in which residual compressive stress exists and a flat portion in which residual tensile stress exists, comprising the steps of:

plastically working a sheet material for forming said bead portion, applying to said bead portion a compressive stress several times as large as the yield point or proof stress of the sheet material so that the residual compressive stress occurs in the bead portion after removing the application of the compressive stress.

2. A method as claimed in claim 1, wherein both the forming of the bead portion and the applying of the pressure to said bead portion are effected locally on the sheet material, and both said forming of the bead portion and the applying of said pressure are repeated to complete the formation of the bead.

3. A method as claimed in claim 1, wherein said sheet is clamped on both sides of an area in which said bead portion is to be formed, the force of clamping being large enough to completely restrain the surrounding sheet from being drawn during forming of the bead portion.

* * * * *